US006030041A

United States Patent [19]

Hsiao

[11] Patent Number: 6,030,041

[45] Date of Patent: Feb. 29, 2000

[54] BACK PAD ADJUSTING STRUCTURE

[76] Inventor: Jin-Long Hsiao, 58, Ma Yuan West St., Taichung, Taiwan

[21] Appl. No.: 09/257,784

[22] Filed: Mar. 2, 1999

[51] Int. Cl.[7] ..... A47C 3/025

[52] U.S. Cl. ..... 297/284.4; 297/284.1

[58] Field of Search ..... 297/284.1, 284.2, 297/284.4, 452.3

[56] References Cited

U.S. PATENT DOCUMENTS 5,335,965 8/1994 Sessini .
5,567,011 10/1996 Sessini .
5,651,583 7/1997 Klingler et al. .
5,704,687 1/1998 Klingler .

*Primary Examiner*—Milton Nelson, Jr.

[57] ABSTRACT

A back pad adjusting structure comprises a back pad, a U shape frame and a guide wire; characterized in that: the back pad is a flexible plate, two sides of the back pad have protrusions, connection portions with screw holes are formed on the two sides of the lower end thereof, a supporting plate extending upwards is mounted on the center portion of the back pad and the top end thereof has an L shape, and slit is formed on the center of the supporting plate; and the U shape frame is formed by an U shape rod penetrating through the two ends of the inverse shape plate, the inverse U shape has holes respective screw holes; and a back pad adjusting structure. By the aforementioned structure, the U shape rod of the U shape frame is penetrated through the long holes on the upper and lower sides of the back pad so that the connection portion of the back pad with the frame plate through screws forms a back pad structure. Thereby, the convex portion of another end of the guide wire passes through the pillar hole below the supporting plate, and then further passes through the slit so as to be buckled within the receiving groove, so that the arc of the back pad can be adjusted, thus the user may adjust the back pad as desired.

2 Claims, 8 Drawing Sheets

BACK PAD ADJUSTING STRUCTURE

BACKGROUND OF THE INVENTION

Although the design of prior art chairs has considered the requirement of ergonomics, since the chair are mass-produced by a standard specification, the user must make his body suit the design of the chair. However, since everybody has his individual physique, thus the design of ergonomics can not be sufficient enjoyed by the user. Often as the user sits by the back to against the chair back, he will feel ache on his back since generally a space is formed between the user's back and the back pad of chair. Therefore, there is an eager demand to have a novel design of back pad of a chair which can be adjusted according to the requirement of users.

SUMMARY OF THE INVENTION

Accordingly, the primary object of the present invention is to provide a back pad adjusting structure comprising a back pad, a U shape frame and a guide wire; characterized in that: the back pad is a flexible plate, two sides of the back pad have protrusions, connection portions with screw holes are formed on the two sides of the lower end thereof, a supporting plate extending upwards is mounted on the center portion of the back pad and the top end thereof has an L shape, and slit is formed on the center of the supporting plate; and the U shape frame is formed by an U shape rod penetrating through the two ends of the inverse shape plate, the inverse U shape has holes respective screw holes; and a back pad adjusting structure. By the aforementioned structure, the U shape rod of the U shape frame penetrates through the long holes on the upper and lower sides of the back pad so that the connection portion of the back pad with the frame plate through screws forms a back pad structure. Thereby, the convex portion of another end of the guide wire passes through the pillar hole below the supporting plate, and then further passes through the slit so as to be buckled within the receiving groove, so that the arc shape of the back pad can be adjusted, thus the user may adjust the back pad 1 as desired.

Therefore, the back pad structure of the present invention has the following advantages:

(1) The arc of the back pad can be adjusted according to the user's demand.

(2) The back pad of the present invention is formed below the chair back so that when the back pad is adjusted by the adjusting button of the present invention, the back pad actually resists against the waist of the user so to provide a supporting force.

The various objects and advantages of the present invention will be more readily understood from the following detailed description when read in conjunction with the appended drawing.

DETAILED DESCRIPTION OF THE PREFERRED EMBODIMENTS

Figure 1:
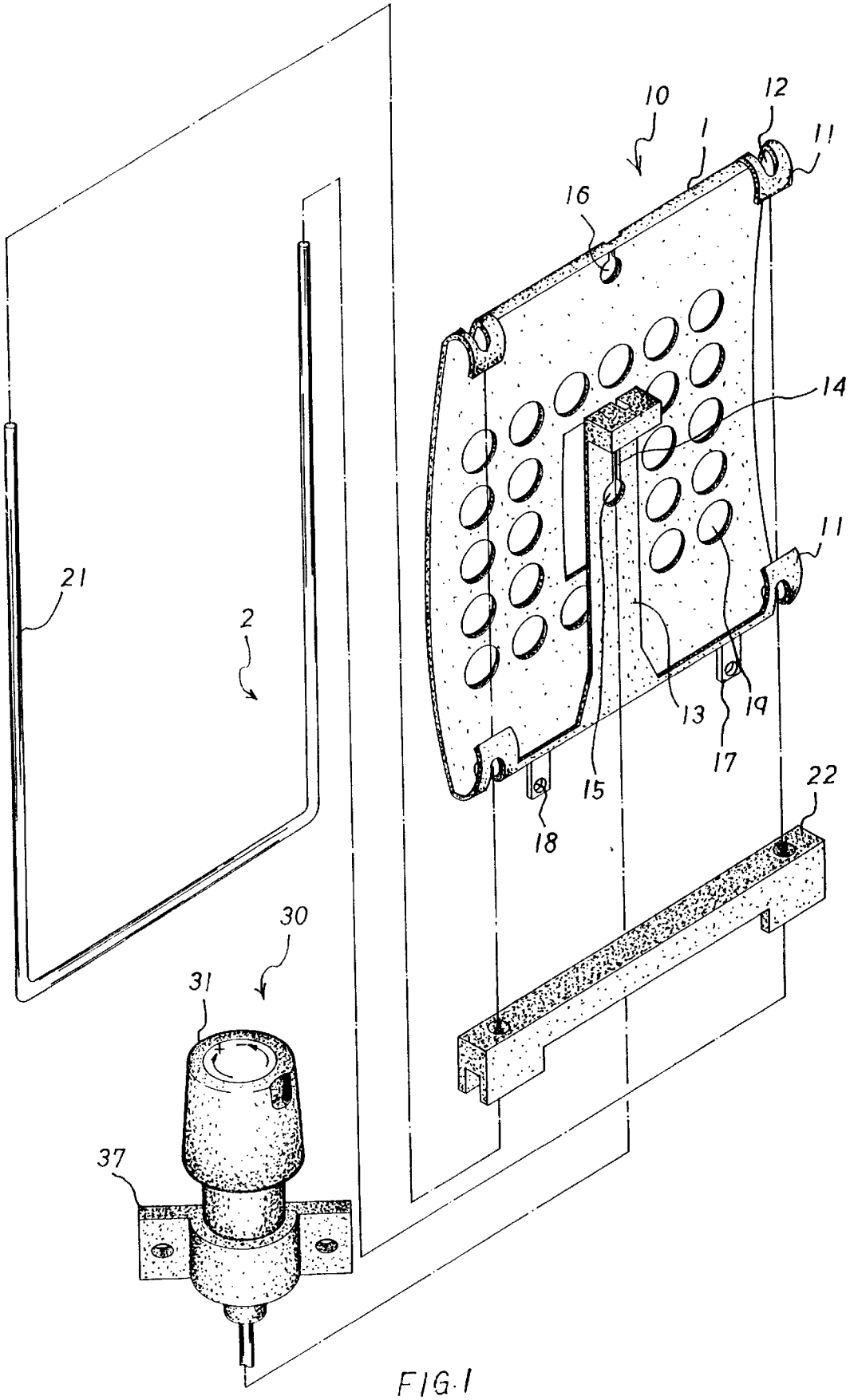
FIG. 1 is a structural view of the present invention.

The present invention related to a back pad adjusting structure. The back pad structure 10 comprises a back pad 1, a U shape frame 2 and a guide wire 4 (as shown in FIG. 1).

Figure 1B:
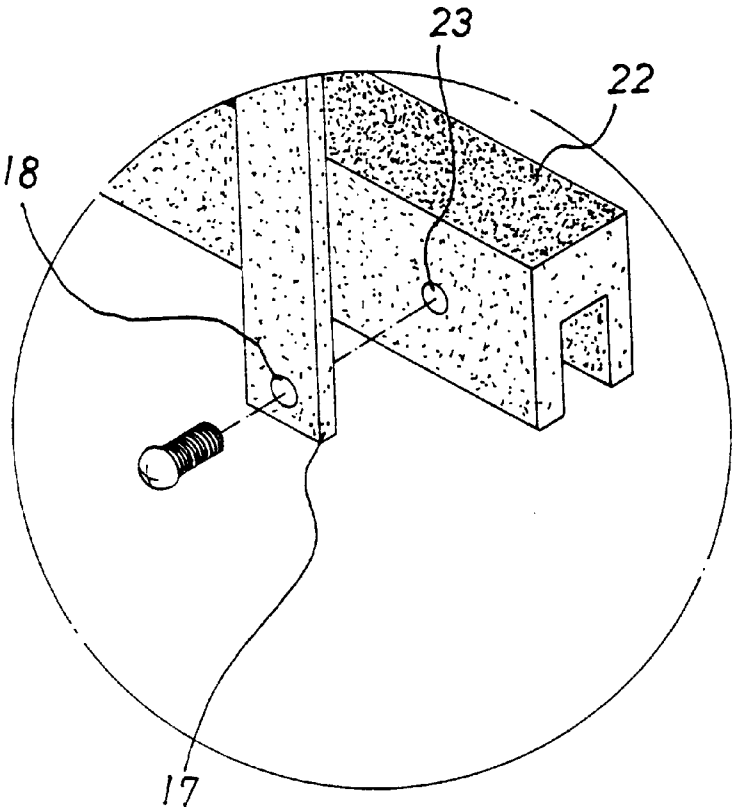
FIG. 1B shows the combination of the connection portion of the back pad and the frame plate.
Figure 1A:
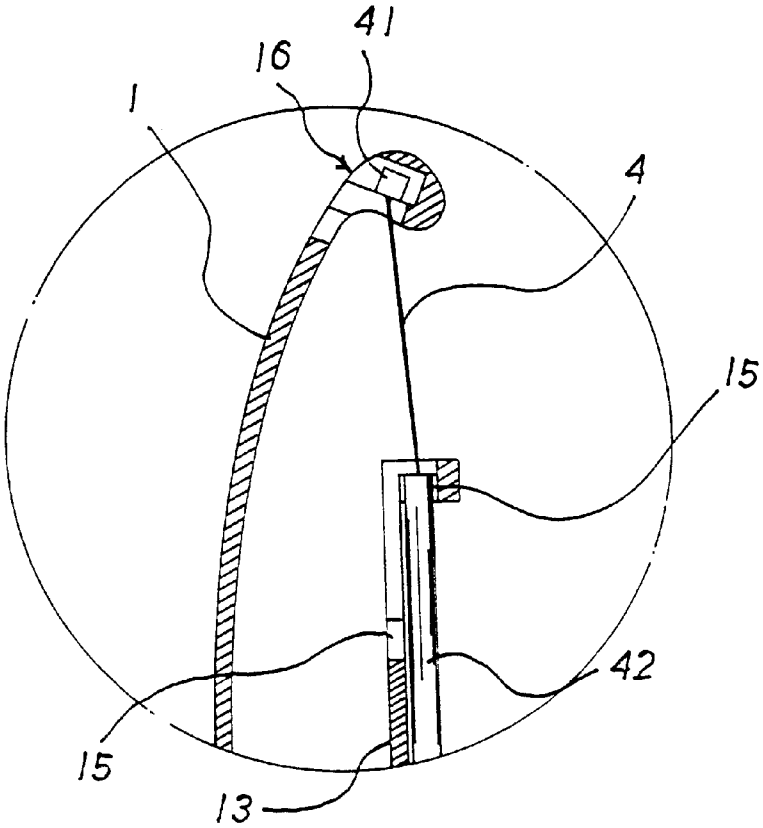
FIG. 1A shows the combination of the back pad and the frame plate of the present invention.
Figure 2:
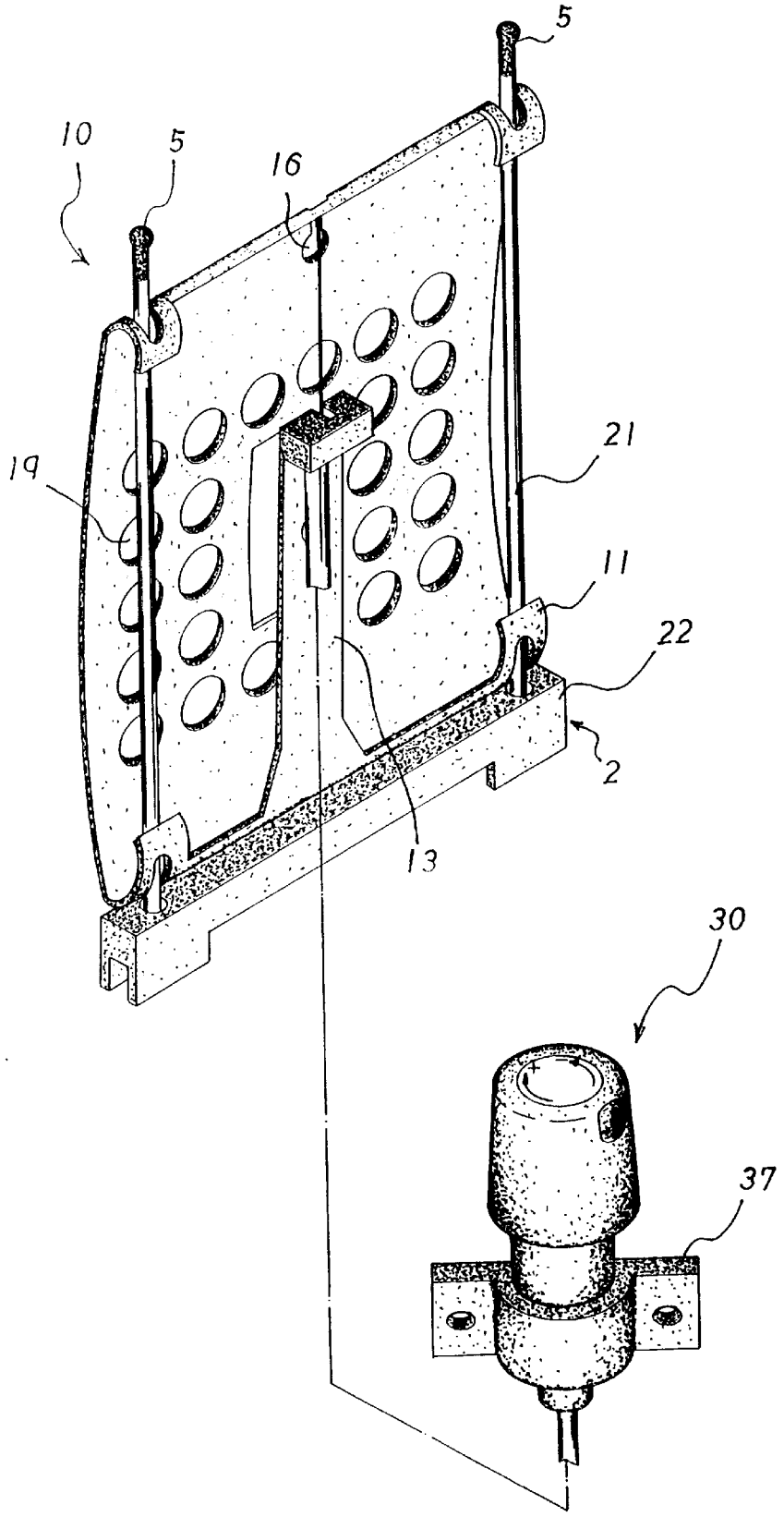
FIG. 2 is a perspective assembly view of a back pad adjusting structure of the present invention.

The back pad 1 is a flexible plate, the plate is slightly curved forwards. Two sides of the back pad 1 have protrusions 11 which bend forward and then toward the center. Each pair of the protrusions 11 are opposite to each other and installed with long hole 12. Connection portions 17 with screw holes 18 are formed on the two sides of the lower end thereof. A supporting plate 13 extending upwards is mounted on the center portion of the back pad and the top end thereof has an L shape, and slit 14 is formed on the center of the supporting plate 13 and the two end of the slit 14 has a pillar hole 15. Above the supporting plate 13 is a receiving groove 15 opposite to the pillar hole 15, as shown in FIGS. 1A, 1B and 2.

The U shape frame 2 is formed by an U shape rod 21 penetrating through the two ends of the inverse U shape plate 22. The inverse U shape 22 has holes 23 with respective to screw holes 18.

The adjusting bottom 30 is formed by a cap 31, a cover 32, a braking screw 33, an adjusting rod 35, and a buckling block 36.

Figure 3:
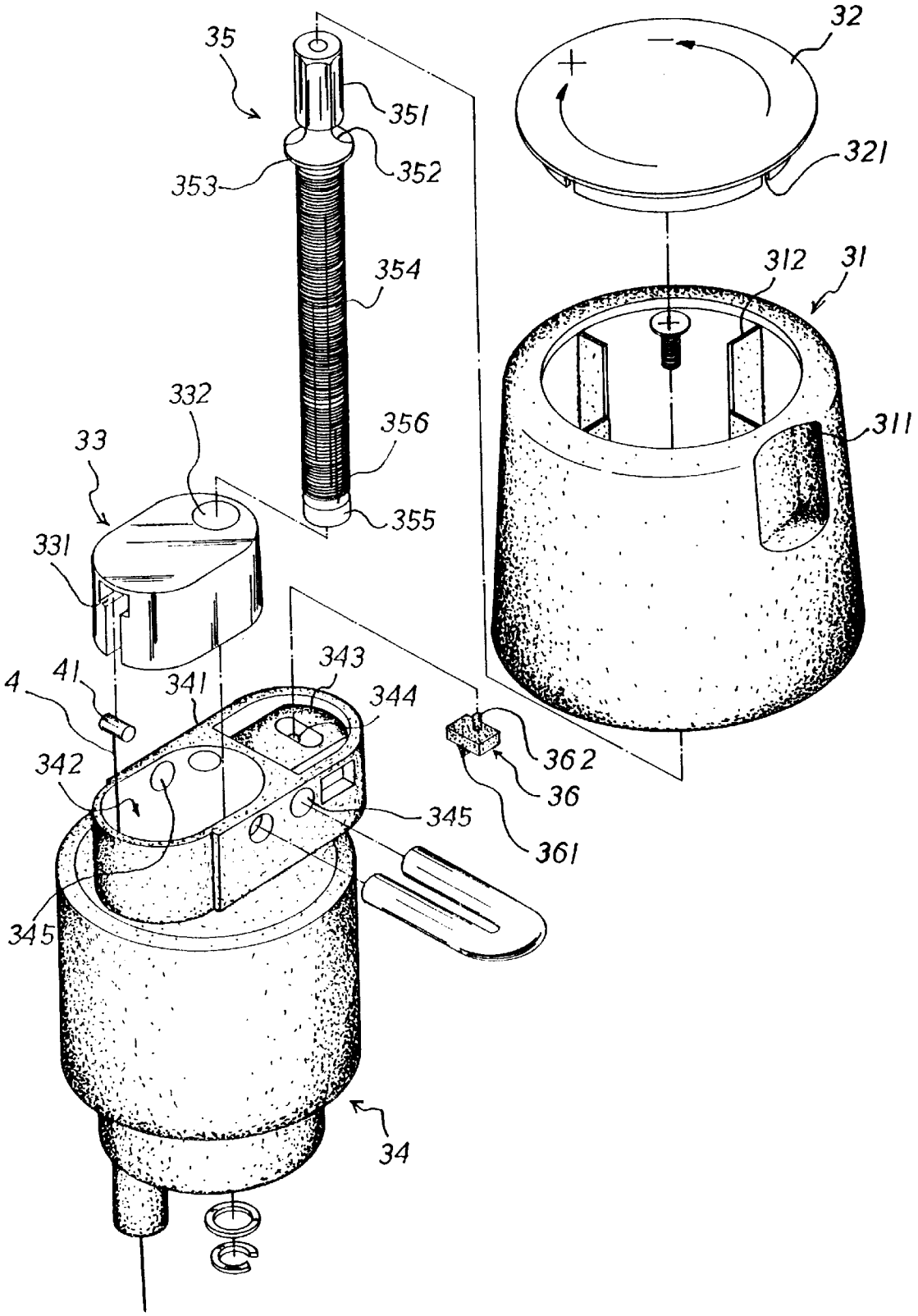
FIG. 3 shows the structure of the adjusting button of the present invention.
Figure 3B:
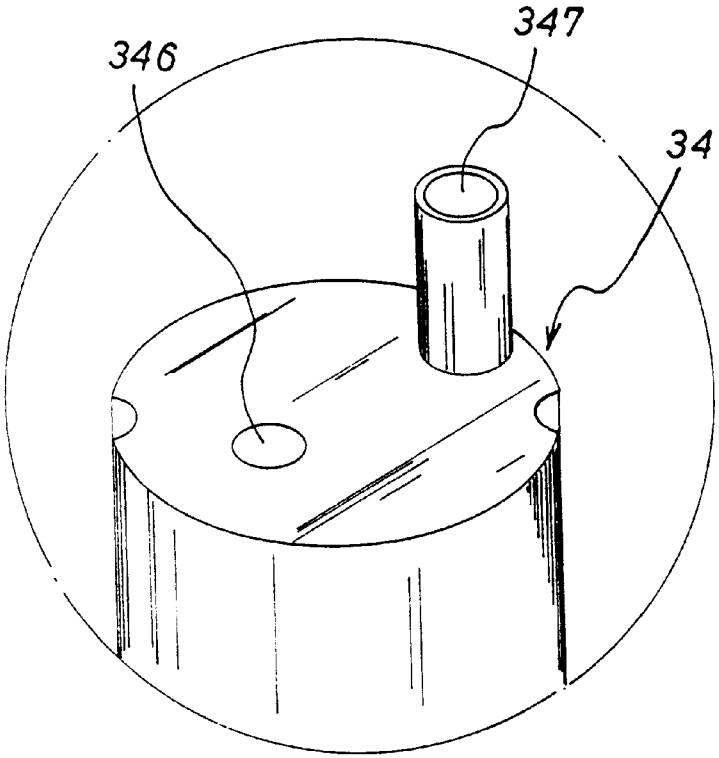
FIG. 3B shows the structure of the seat of the adjusting button according to the present invention.
Figure 3A:
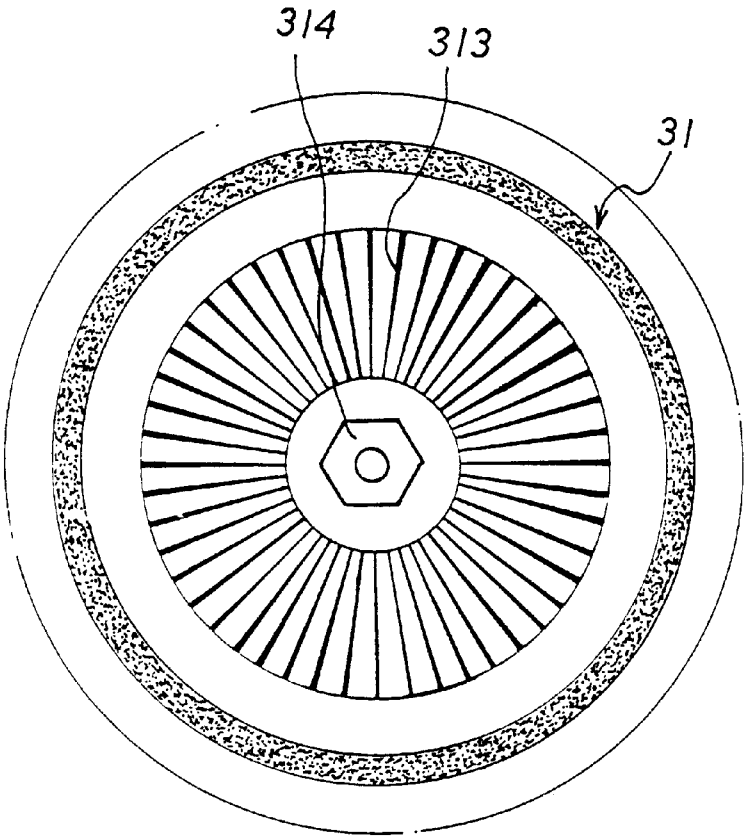
FIG. 3A shows the cap of the adjusting button of the present invention.

The cap 31 is a tapered cover with concave portion 311. Opposite ribs 312 are formed therewithin, which are connected to the fan shape teeth 313 on the lower surface of the cap 31. A buckling hole 314 with respect to the screw rod 351 of the adjusting rod 35 (as shown in FIG. 3A).

The cover 32 is round disk with a buckling groove 321 and with respect to the rib 31 of the cap 31.

The braking screw 33 is an oblong screw, one side of which is inwards installed with a receiving bole 331 of the guide wire 4.

The seat 4 has a pillar shape. A groove 342, a penetrating hole 346 and a through hole 347 are formed on the oblong base 341 on the top thereof for receiving the braking screw 33. An elastic piece 343 is installed on the side of the oblong base 341. A reduced cylindrical receiving groove 344 is formed on the elastic piece 343. Each side of the oblong base 341 with respect to the screw hole 332 of the braking screw 33 has a respective pin hole 345 (as shown in FIG. 3B).

The adjusting rod 35 is formed by a stud head 351 to penetrate through the semi-cambered neck portion 352 and ring 353 and then to be connected to a rod 354. A reduced portion 355 and concave ring surface 356 is formed on the bottom of the rod 354.

The buckling block 36 is a plate with a single tooth 361 projected from the surface thereof and a rod 362 on the lower end.

By the aforementioned structure, the U shape rod 21 of the U shape frame 2 penetrats through the long holes 12 on the upper and lower sides of the back pad 1 so that the connection portion 17 of the back pad 1 with the frame plate 22 through screws forms a back pad structure. Moreover, in the adjusting button 30, the guide wire 4 passes through the through hole 347 on the lower portion of the seat 34 and then buckles within the braking screw 33. Then the braking screw 33 is located within the groove 342 of the seat 34. Next, the rod 354 of the adjusting rod 35 is screwed into the screw hole 332 of the braking screw 33 so that the reduced portion 355 thereof penetrates through the through hole 346. Thus, after a washer is arranged, a C ring will be buckled on the ring surface 356 so as to prevent the adjusting rod 35 to drop out. Moreover, by a U shape pin to penetrate through the pin hole 345, it is firmly installed on two sides of the semi-cambered shape neck portion 352, then the rod 362 of the buckling block 36 is inserted into the receiving groove 344 of the elastic piece 343 so to swing leftwards and rearwards. Then the buckling hole 314 of the cap 31 is firmly buckled to the stud head 351. Then the fan shape teeth 313 will engage with the buckling block 36, The cover 32 is then firmly secured to the cap 31. Thereby, the convex portion 41 of another end of the guide wire 4 passes through the pillar hole 15 below the supporting plate 13 and then further passes through the slit 14 so as to be buckled within the receiving groove 16 (convex portion 41 of another end of the guide wire 4 has been connected to the adjusting button 30) so that the guide wire tube 42 outside the guide wire 4 resists against the pillar hole 15. Thus the convex portion 41 of the receiving groove 16 and guide wire tube 42 are aligned along a straight line. Then two ends of the U shape rod 21 is connected to the sleeve 5 and then is bent backwards so that in the back pad 1, the end portion of the U shape rod 21 is firmly secured to the lower portion of the chair back 61 of the chair 6. Next, the adjusting button 30 is screwedly fixed to the proper position of the chair 6 through a tube holder 37.

Figure 4A:
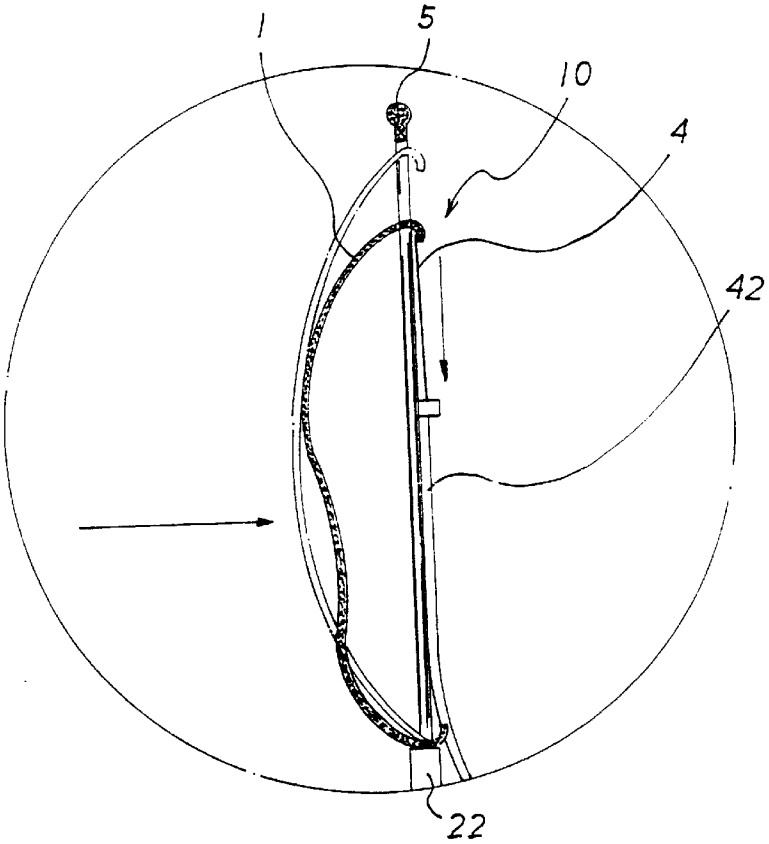
FIG. 4A shows that the back pad of the present invention with respect to the support of human body.
Figure 4:
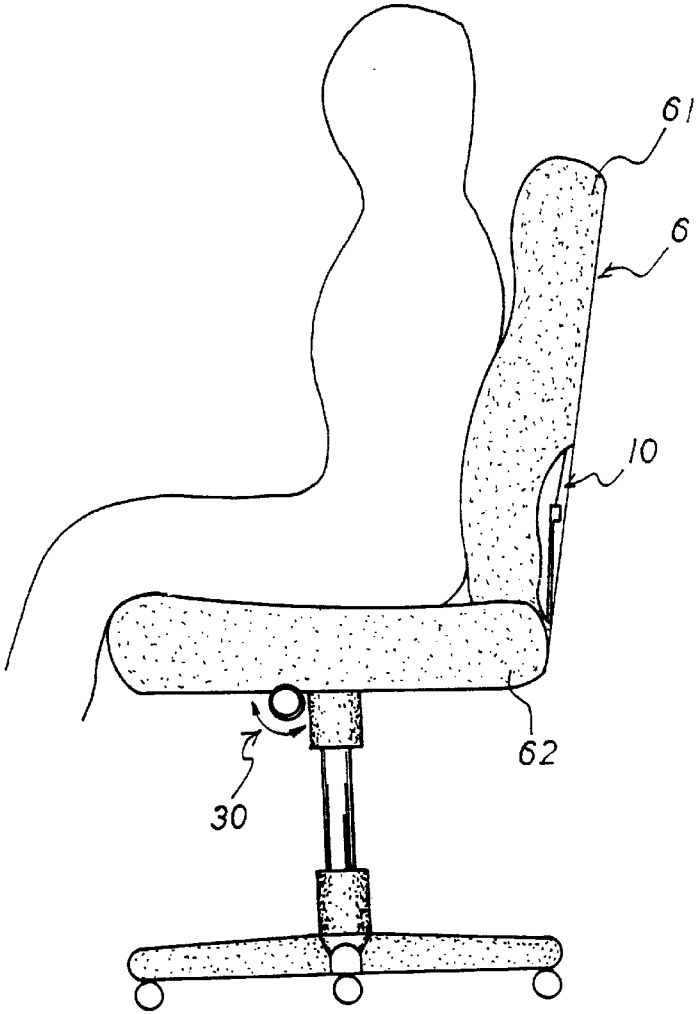
FIG. 4 is a schematic view showing an embodiment of the present invention.

When embodying the present invention (as shown in FIGS. 4 and 4A), since the back pad 1 is a flexible body with a slight curved plate surface, while by the long hole 12, the upper end thereof is slidable with the U shape rod 21, therefore, when rotating the adjusting button 30 to pull the guide wire 4, since the supporting plate 13 resists against the guide wire tube 42 so that the top end of the back pad 1 will be pulled downwards, thus the back pad 1 will bend forwards and downwards (In other words, if the adjusting button 30 is rotated inversely, the back pad 1 will restore to an original upright position) so that the arc of the back pad 1 can be adjusted, thus the user may adjust the back pad 1 as desired.

Moreover, a plurality of holes 19 can be designed on the back pad 1 for being passed through by air. Moreover, the back pad 1 of the present invention can be design to suit various kinds of chair back 61 of chair 6.

Figure 5:
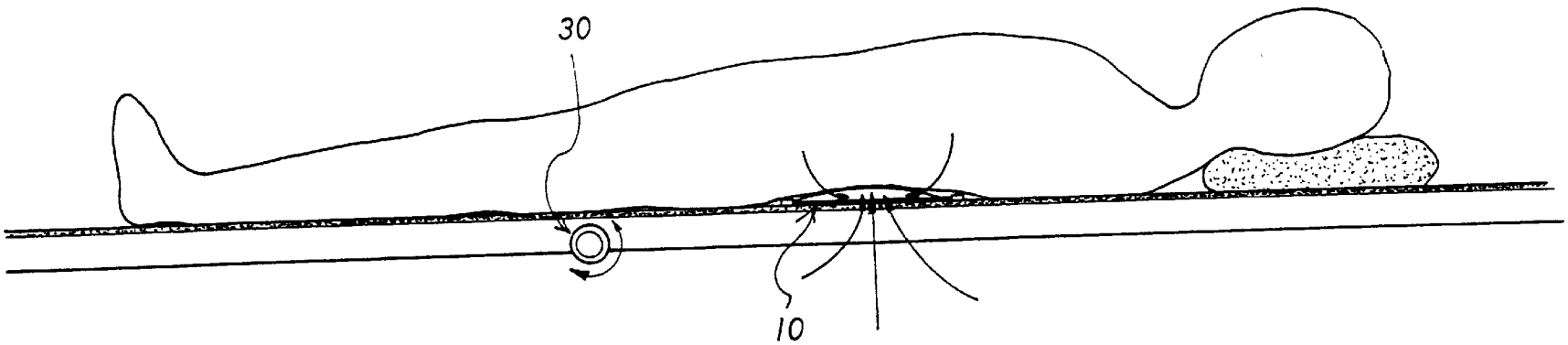
FIG. 5 is a schematic view showing that the present invention is applied to a bed.
Figure 6:
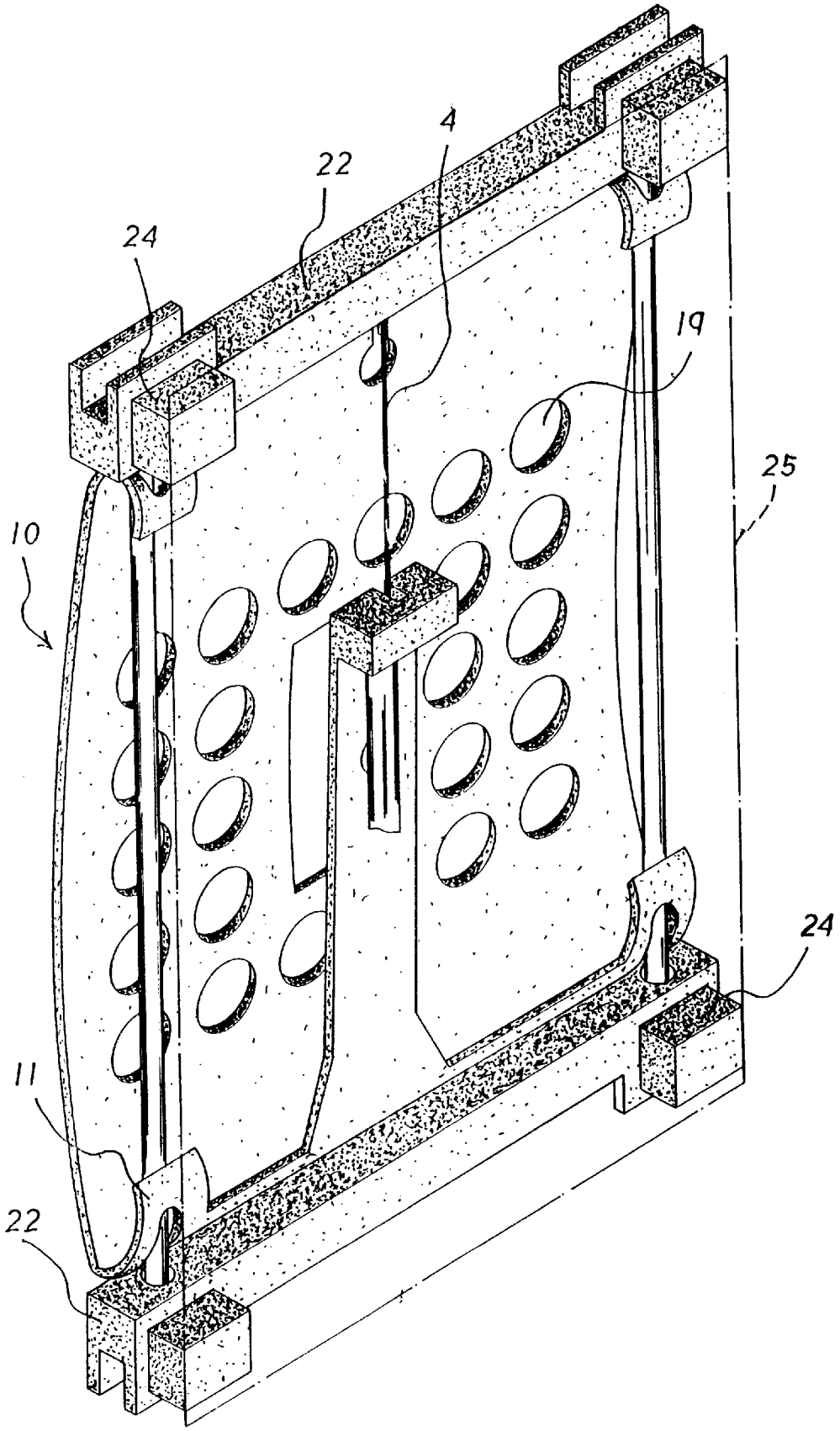
FIG. 6 shows another embodiment of the back pad structure according to the present invention.

The upper and lower protrusions 11 of the back pad 1 are installed with respective frame plates 22. Therefore, as the present invention is mounted on a bed (for patient), by the supporting of the frame plates 22, the U shape rod 21 can be lifted so that the back pad 1 can be adjusted and slid (as shown in FIGS. 5 and 6).

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A back pad adjusting structure comprising a back pad, a U shape frame and a guide wire; characterized in that:

the back pad is a flexible plate, the plate is slightly curved forwards, two sides of the back pad have protrusions which bend forward and then toward the center, each pair of the protrusions are opposite to one another and installed with a long hole, connection portions with screw holes are formed on the two sides of the lower end thereof, a supporting plate extending upwards is mounted on the center portion of the back pad and the top end thereof has an L shape, and a slit is formed on the center of the supporting plate and the two ends of the slit have respective pillar holes, above the supporting plate is a receiving groove opposite to the pillar hole; and the U shape frame is formed by a U shape rod penetrating through the two ends of an inverse shape plate, the inverse U shape plate has holes with respect to screw holes;

the U shape rod of the U shape frame penetrates through long holes on the upper and lower sides of the back pad so that a connection portion of the back pad with a frame plate through screws forms a back pad structure, thereby, a convex portion of another end of the guide wire passes through the pillar hole below the supporting plate, and then further passes through the slit so as to be buckled within the receiving groove so that a guide wire tube outside the guide wire resists against the pillar hole, thus a convex portion of the receiving groove and guide wire tube are aligned along a straight line, then two ends of the U shape rod are connected to the sleeve and then are bent backwards so that in the back pad, the end portion of the shape rod is firmly secured to the lower portion of a chair back of a chair, and then an adjusting button is screwedly fixed to a proper position of the chair through a tube holder, so that the arc shape of the back pad can be adjusted.

2. The back pad adjusting structure as claimed in claim 1, wherein the adjusting button comprising a cap, a cover, a braking screw, an adjusting rod, and a buckling block; characterized in that:

the cap is a tapered cover with a concave portion, a plurality of opposite ribs are formed in the cap, which are connected to a plurality of fan shape teeth on the lower surface of the cap, a buckling hole with respect to a screw rod of the adjusting rod is formed on the cap;

the cover is a round disk with a buckling groove and with respect to the rib of the cap;

the braking screw is an oblong screw, one side of which is installed with a receiving hole of the guide wire;

a seat is designed as a pillar, while a groove, a penetrating hole and a through hole are formed on an oblong base on a top thereof for receiving the braking screw, an elastic piece is installed on a side of the oblong base, a reduced cylindrical receiving groove is formed on the elastic piece, each side of the oblong base with respect to a screw hole of the braking screw has a respective pin hole;

the adjusting rod is formed by a stud head to penetrate through a semi-cambered neck portion and ring and then to be connected to a rod, a reduced portion and a concave ring surface are formed on the bottom of the rod; and the buckling block is a plate with a single tooth projected from the surface thereof and a rod on the lower end;

wherein in the adjusting button, the guide wire passes through the through hole on the lower portion of the seat and then buckles within the braking screw, then the braking screw is located within the groove of the seat, next, the rod of the adjusting rod is screwed into the screw hole of the braking screw so that the reduced portion thereof penetrates through the through hole, thus, after a washer is arranged, a C ring will be buckled on the ring surface so as to prevent the adjusting rod from dropping out, moreover, by a U shape pin to penetrate through the pin hole, and then it is firmly installed on two sides of the semi-cambered shape neck portion, the rod of the buckling block is inserted into the receiving groove of the elastic piece so to swing leftwards and rearwards, next, the buckling hole of the cap is firmly buckled to the stud head, the fan shape teeth will then engage with the buckling block, and the cover is firmly secured to the cap.

* * * * *